US012084829B2

(12) United States Patent
Gentle

(10) Patent No.: US 12,084,829 B2
(45) Date of Patent: Sep. 10, 2024

(54) SYSTEMS AND METHODS FOR AUTOMATICALLY ADJUSTING A MOTOR GRADER

(71) Applicant: Caterpillar Inc., Peoria, IL (US)

(72) Inventor: Michael C. Gentle, Maroa, IL (US)

(73) Assignee: Caterpillar Inc., Peoria, IL (US)

( * ) Notice: Subject to any disclaimer, the term of this patent is extended or adjusted under 35 U.S.C. 154(b) by 740 days.

(21) Appl. No.: 17/342,403

(22) Filed: Jun. 8, 2021

(65) Prior Publication Data

US 2022/0396928 A1 Dec. 15, 2022

(51) Int. Cl.
*E02F 3/84* (2006.01)
*E02F 3/76* (2006.01)

(52) U.S. Cl.
CPC ..... *E02F 3/844* (2013.01); *E02F 3/7613* (2013.01); *E02F 3/7636* (2013.01)

(58) Field of Classification Search
CPC ..... E02F 3/844; E02F 3/7613; E02F 3/7636; E02F 3/764; E02F 9/0841; E02F 9/265
See application file for complete search history.

(56) References Cited

U.S. PATENT DOCUMENTS

| | | | | |
|---|---|---|---|---|
| 4,926,948 | A | 5/1990 | Davidson et al. | |
| 6,857,494 | B2 | 2/2005 | Kobayashi et al. | |
| 7,000,338 | B2 | 2/2006 | Savard | |
| 7,908,775 | B2 | 3/2011 | Mishra et al. | |
| 8,807,261 | B2 | 8/2014 | Subrt et al. | |
| 9,051,711 | B2 | 6/2015 | Sharma et al. | |
| 2013/0304331 | A1 | 11/2013 | Braunstein et al. | |
| 2017/0114523 | A1* | 4/2017 | Horstman | E02F 9/2087 |
| 2018/0038066 | A1 | 2/2018 | Gentle et al. | |
| 2020/0055544 | A1 | 2/2020 | Veasy et al. | |
| 2020/0173135 | A1* | 6/2020 | Gentle | E02F 3/7627 |

FOREIGN PATENT DOCUMENTS

CN 201443061 U 4/2010

* cited by examiner

*Primary Examiner* — Tyler J Lee
*Assistant Examiner* — Yufeng Zhang
(74) *Attorney, Agent, or Firm* — Perkins Coie LLP

(57) ABSTRACT

Systems and methods for automatically adjusting a motor grader can include receiving one or more identifiers corresponding to a configuration of the motor grader; determining, based at least in part on the one or more identifiers, a position of a leading edge of a blade of the motor grader relative to a rear frame axis of the motor grader; and, if the determined position is not within an operating threshold, causing a frame actuator of the motor grader to change an articulation angle of the frame to move the leading edge to within the acceptable threshold.

21 Claims, 7 Drawing Sheets

SYSTEMS AND METHODS FOR AUTOMATICALLY ADJUSTING A MOTOR GRADER

TECHNICAL FIELD

The present disclosure relates to systems and methods for automatically adjusting an industrial machine, including automatically articulating a motor grader based on a position of a reversible blade.

BACKGROUND

Motor graders are frequently employed to level or remove dirt, gravel, snow, and other materials from a surface, such as a road. Typical motor graders include a frame pivotably coupled to a rear frame. Some motor graders additionally include a reversible blade mounted to the front of the frame. These reversible blades can be angled to shift sideways the material being graded relative to the motor grader direction of travel, which can lead to an uneven load distribution and can increase the difficulty of operating the motor grader. For example, when in use, the forces exerted on an angled reversible blade can cause the front end of the motor grader to be pulled towards a leading edge of the blade and can cause the machine to slide.

U.S. Pat. App. No. 2013/0304331A1 to Braunstein (hereinafter "Braunstein") describes a method of controlling a motor grader near a curb or other roadway marker. In particular, Braunstein describes an automatic blade mode wherein a blade assembly is automatically positioned relative to a road marker while an operator controls the positioning of the machine via steering and articulation. Braunstein describes cooperatively controlling the frame articulation and blade shift to maintain a desired spacing between an edge of the blade assembly and the road marker. Additionally, Braunstein only discloses adjusting the frame articulation in cooperation with the blade shift and does not disclose adjusting the frame articulation in isolation. Moreover, the blade disclosed in Braunstein is not a front reversible blade, so the methods disclosed by Braunstein may not be applicable to controlling a motor grader having a front reversible blade.

SUMMARY

In some embodiments, a method for automatically adjusting a motor grader includes receiving one or more identifiers corresponding to a configuration of the motor grader. The motor grader can include a rear frame having a rear frame axis. The motor grader can further include a front frame having a first front frame end portion, a front frame axis, and a second front frame end portion spaced apart from the first front frame end portion along the front frame axis, wherein the first front frame end portion includes a blade actuator, and the second front frame end portion is pivotably coupled to the rear frame. The motor grader can further include a blade rotatably coupled to the first front frame end portion and operably connected to the blade actuator, and the blade can include a leading edge. The motor grader can further include a frame actuator connected to the rear frame and the front frame, and the frame actuator can be configured to change an articulation angle between the rear frame axis and the front frame axis. The method can further include determining, based at least in part on the one or more identifiers, a position of the leading edge relative to the rear frame axis; and if the position is not within an operating threshold, causing the frame actuator to change the articulation angle to move the leading edge to within the acceptable threshold.

In some embodiments, a motor grader can include a rear frame having a rear frame axis, and a front frame having a first front frame end portion, a front frame axis, and a second front frame end portion spaced apart from the first front frame end portion along the front frame axis. The first front frame end portion can include a blade actuator, and the second front frame end portion can be pivotably coupled to the rear frame. The motor grader can further include a blade pivotably coupled to the first front frame end portion and operably connected to the blade actuator, and the blade can include a leading edge. The motor grader can further include a frame actuator connected to the rear frame and the front frame, and the frame actuator can be configured to change an articulation angle between the rear frame axis and the front frame axis. The motor grader can further include one or more processors; and one or more memory devices having stored thereon instructions that when executed by the one or more processors cause the one or more processors to perform at least one of the following: (i) receive one or more identifiers corresponding to a configuration of the motor grader; (ii) determine, based at least in part on the one or more identifiers, a position of the leading edge relative to the rear frame axis; and, (iii) if the position is not within an operating threshold, cause the frame actuator to change the articulation angle to move the leading edge to within the operating threshold.

In some embodiments, a system for automatically adjusting a blade assembly can include a motor grader and one or more non-transitory computer-readable media. The motor grader can include a rear frame having a rear frame axis, and a front frame having a first front frame end portion, a front frame axis, and a second front frame end portion spaced apart from the first front frame end portion along the front frame axis. The first front frame end portion can include a blade actuator, and the second front frame end portion can be pivotably coupled to the rear frame. The motor grader can further include a blade rotatably coupled to the first front frame end portion and operably connected to the blade actuator, and the blade can include a leading edge. The motor grader can further include a frame actuator connected to the rear frame and the front frame, and the frame actuator can be configured to change an articulation angle between the rear frame axis and the front frame axis. The motor grader can further include one or more sensors configured to determine a configuration of the motor grader. The one or more non-transitory computer-readable media can store computer-executable instructions that, when executed by one or more processors, can cause the one or more processors to perform operations include at least one of the following: (i) receive, via a controller communicatively coupled to the one or more sensors, one or more identifiers corresponding to a configuration of the motor grader; (ii) determine, via the controller and based at least in part on the one or more identifiers, a position of the leading edge relative to the rear frame axis; and (iii) if the position is not within an operating threshold, cause the controller to actuate the frame actuator to change the articulation angle to move the leading edge to within the operating threshold.

Other aspects will appear hereinafter. The features described herein can be used separately or together, or in various combinations of one or more of them.

BRIEF DESCRIPTION OF THE DRAWINGS

Many aspects of the present technology can be better understood with reference to the following drawings. The components in the drawings are not necessarily drawn to scale. Instead, emphasis is placed on illustrating clearly the principles of the present technology. For example, the dimensions of some of the elements in the figures may be expanded or reduced to help improve the understanding of the embodiments. Furthermore, components can be shown as transparent in certain views for clarity of illustration only and not to indicate that the component is necessarily transparent. Components may also be shown schematically.

Figure 1A:
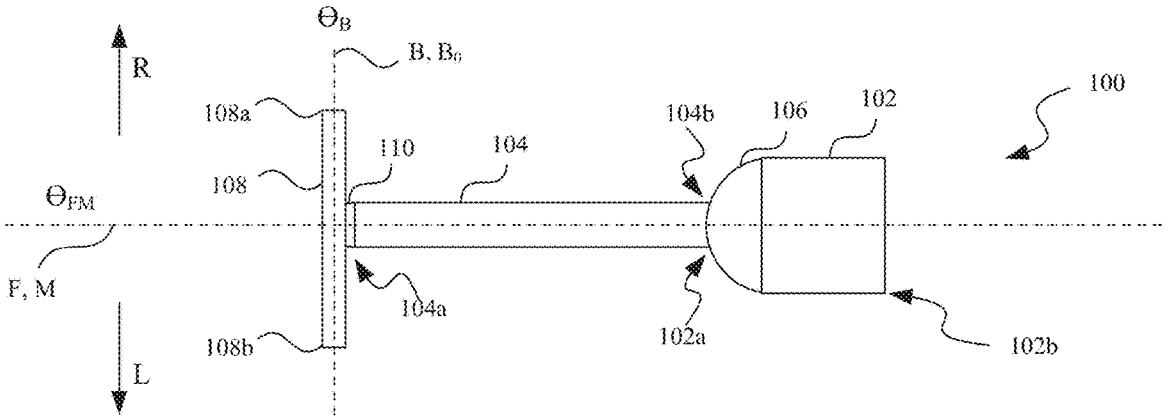
FIGS. 1A-1C are schematic illustrations of a machine comprising a blade configured in accordance with select embodiments of the present technology.

The headings provided herein are for convenience only and do not necessarily affect the scope of the embodiments. Moreover, while the disclosed technology is amenable to various modifications and alternative forms, specific embodiments have been shown by way of example in the drawings and are described in detail below. The intention, however, is not to unnecessarily limit the embodiments described. Rather, the claims are intended to cover all modifications, combinations, equivalents, and alternatives as construed in accordance with this disclosure.

DETAILED DESCRIPTION

The following description provides specific details for a thorough understanding and enabling description of various embodiments of the present technology. One skilled in the relevant art will understand, however, that the techniques and technology discussed herein may be practiced without many of these details. Likewise, one skilled in the relevant art will also understand that the technology can include many other features not described in detail herein. Additionally, some well-known structures or functions may not be shown or described in detail below so as to avoid unnecessarily obscuring the relevant description. Accordingly, embodiments of the present technology may include additional elements or exclude some of the elements described below with reference to the Figures, which illustrate examples of the technology.

The terminology used in this description is intended to be interpreted in its broadest reasonable manner, even though it is being used in conjunction with a detailed description of certain specific embodiments of the invention. Certain terms may even be emphasized below; however, any terminology intended to be interpreted in any restricted manner will be overtly and specifically defined as such.

Automatic Articulation

Figure 1B:
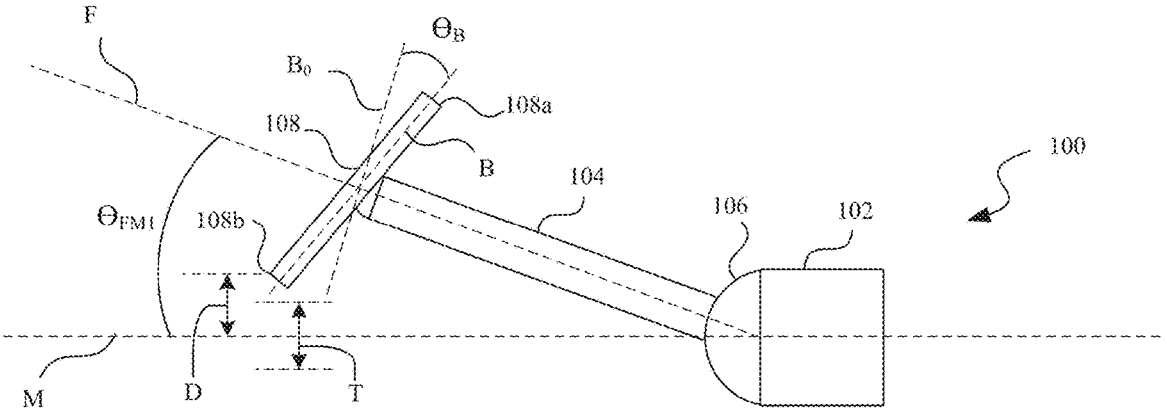
Figure 1C:
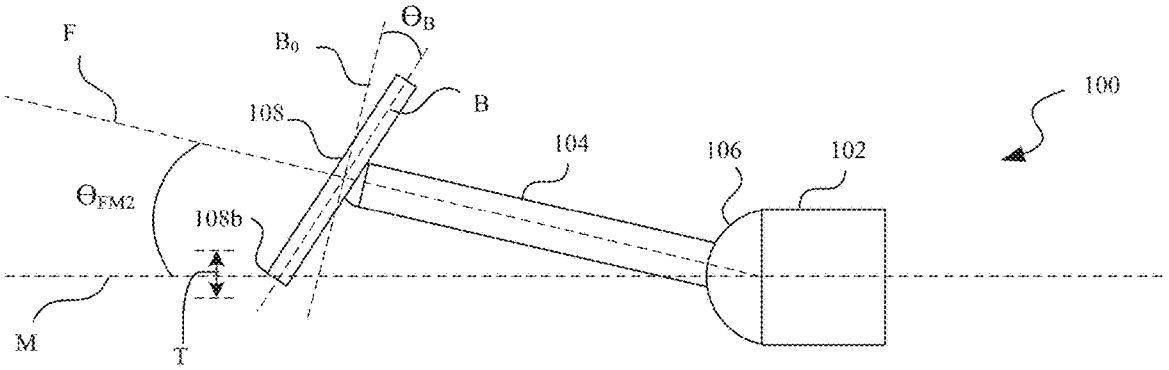

FIGS. 1A-1C are schematic illustrations of a machine 100 comprising a blade 108 configured in accordance with select embodiments of the present technology. The machine 100 can be an industrial machine such as a motor grader, or any other suitable machine or equipment.

Referring first to FIG. 1A, the machine 100 can include a rear frame 102 having a first (e.g., front, forward) end portion 102*a* and a second (e.g., back, rear) end portion 102*b*. The rear frame 102 can have a rear frame longitudinal axis M. In some embodiments, the rear frame longitudinal axis M can be a centerline of the machine 100. The system 100 can further include an elongate front frame or front frame 104 having a first (e.g., front, forward) end portion 104*a* and a second (back, rear) end portion 104*b*. The front frame 104 can have a front frame longitudinal axis F. In the illustrated embodiment, the rear frame longitudinal axis M and the front frame longitudinal axis F are generally aligned or colinear, e.g., such that a frame angle $\Theta_{FM}$ between the rear frame longitudinal axis M and the front frame longitudinal axis F is approximately zero degrees. In some embodiments, this can represent a default or neutral orientation for the front frame 104 and/or the rear frame 102.

The second end portion 104*b* of the front frame 104 can be coupled (e.g., pivotably coupled) to the first end portion 102*a* of the rear frame 102 by a frame actuator or articulation element 106. In an alternate embodiment, coupling may comprise rotatably coupling or operably coupling. The frame actuator 106 can be configured to rotate and/or pivot the front frame 104 relative to the rear frame 102, e.g., to rotate or pivot the front frame longitudinal axis F relative to the rear frame longitudinal axis M. In the illustrated embodiment, for example, the frame actuator 106 can rotate the front frame 104 in a first (e.g., right, negative, clockwise) direction R, and a second (e.g., left, positive, counterclockwise) direction L. The first direction R can correspond to a negative angle or rotation (e.g., a −15° rotation) relative to the rear frame longitudinal axis M, and the second direction L can correspond to a positive angle or rotation (e.g., a +15° rotation) relative to the rear frame longitudinal axis M. The frame actuator 106 can include, for example, one or more motors, solenoids, actuators, pistons, hydraulics, gears, joints, a combination thereof, and/or any other suitable articulation element.

The machine 100 can further include a blade 108 having a first (e.g., right) edge 108*a* and a second (e.g., left) edge 108*b*. In at least some embodiments, the blade 108 can be a reversible blade, such as a front reversible blade configured for use with a motor grader or other industrial machine. In some embodiments, the first edge 108*a* or the second edge 108*b* can be a leading edge, and the other edge can be a trailing edge. The blade 108 can have a blade longitudinal axis B. In the illustrated embodiment, the blade longitudinal axis B is generally perpendicular to the front frame longitudinal axis F; this can be a default or reference orientation $B_0$ for the blade 108.

Figure 2A:
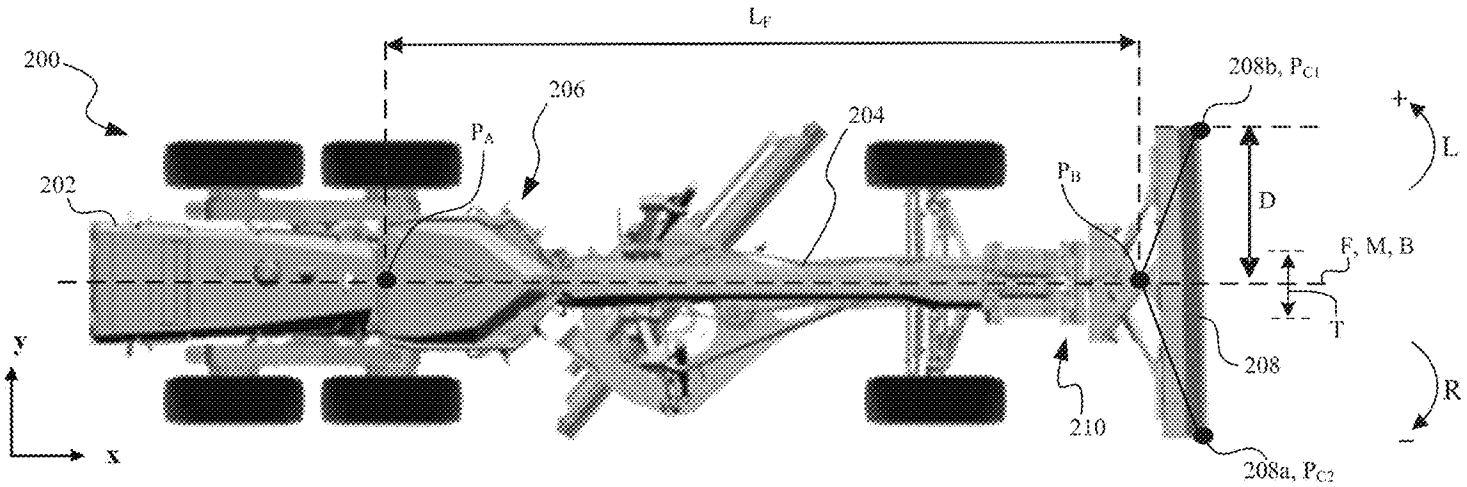
FIGS. 2A and 2B are top views of an exemplary industrial machine comprising a blade configured in accordance with select embodiments of the present technology.
Figure 2B:
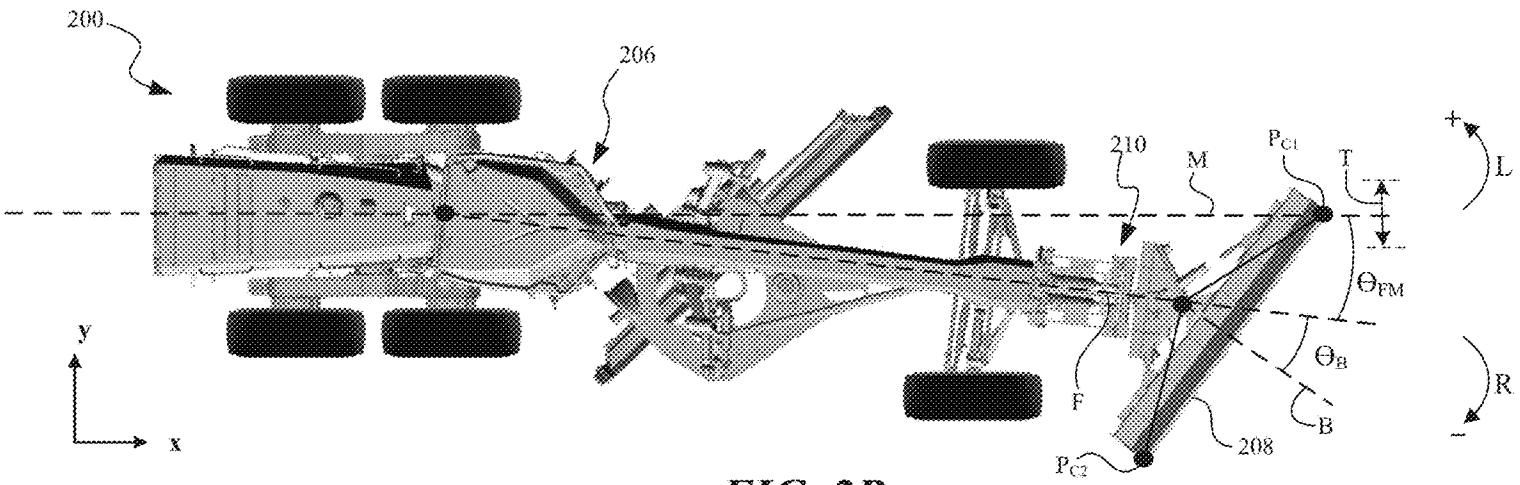

The blade 108 can be coupled (e.g., pivotably coupled, etc.) to the first end portion 104*a* of the front frame 104 by a blade actuator or actuation element 110. The blade actuator 110 can be configured to rotate and/or pivot the blade 108 relative to the front frame 104, e.g., to rotate or pivot the blade longitudinal axis B relative to the reference orientation $B_0$. In the illustrated embodiment, for example, the blade actuator 110 can rotate the blade 108 in the first direction R and the second direction L. The first direction R can correspond to a negative and/or rightward angle or rotation (e.g., a −15° rotation) relative to the front frame longitudinal axis F and/or the reference orientation $B_0$, and the second direction L can correspond to a positive and/or leftward angle or rotation (e.g., a +15° rotation) relative to the reference orientation $B_0$. In some embodiments, the blade axis B can be perpendicular to a longitudinal axis of the blade, and the rotation of the blade 108 can be measured relative to the front frame longitudinal axis F, e.g., as best seen in FIGS. 2A-2B. The blade actuator 110 can include, for example, one or more motors, actuators, solenoids, pistons, hydraulics, gears, joints, a combination thereof, and/or any other suitable articulation element.

Referring next to FIG. 1B, in the illustrated embodiment, the front frame 104 has been rotated by the frame actuator or articulation element 106 relative to the rear frame 102, and the front frame longitudinal axis F is at a first frame angle $\Theta_{FM1}$ relative to the rear frame longitudinal axis M. Additionally, in the illustrated embodiment, the blade 108 has been rotated by the blade actuator or actuation element 110 relative to the front frame 104, and the blade longitudinal axis B is at a blade angle $\Theta_B$ relative to the blade reference orientation $B_0$. Accordingly, the second edge 108*b* is a distance D from the rear frame longitudinal axis M. The distance D can be a linear distance, an arc length, and/or any other suitable measurement.

The distance D can be determined (e.g., automatically determined) based on a configuration of the machine 100 and/or a dimension(s) of one or more components thereof. In at least some embodiments, for example, the distance D can be determined based on the first frame angle $\Theta_{FM1}$, the blade angle $\Theta_B$, a length of the front frame 104, and/or a blade length of the blade 108. This is described in greater detail below and with reference to FIGS. 2A-2B.

In some embodiments, the configuration of the machine 100 and/or the dimension(s) of the one or more components thereof can each correspond to one or more identifiers, such that the distance D can be determined based on the one or more identifiers. The one or more identifiers are described in greater detail below and with reference to FIGS. 3 and 4.

In the illustrated embodiment, the second edge 108*b* is positioned a greater distance from the rear frame 102 than the first edge 108*a*, such that the second edge 108*b* can be a leading edge when the machine 100 moves forward. In other embodiments, based on the relative positions of the first and second edges 108*a-b*, the first edge can be the leading edge. In at least some embodiments, the leading edge can be determined (e.g., automatically determined) by using on the blade angle $\Theta_B$ and/or the first front frame angle $\Theta_{FM1}$, e.g., to determine an orientation of the first edge 108*a* relative to the second edge 108*b*. In some embodiments, the leading edge can be selected by a user (e.g., an operator) of the machine 100.

The position of the blade 108 relative to the rear frame 102 can be adjusted or controlled, e.g., to adjust or control the distance D between the second (e.g., leading) edge 108*b* and the rear frame longitudinal axis M. In some embodiments, for example, the system 100 may include an operating or performance threshold T. In the illustrated embodiment, the operating threshold T is defined relative to the rear frame longitudinal axis M. As described in greater detail below, the orientation of the leading edge (e.g., second edge 108*b*) can be adjusted or controlled such that the leading edge remains positioned within the operating threshold T, and/or the machine 100 can be configured to more the leading edge from a first position outside (e.g., not within) the operating threshold T to a second position within the operating threshold T. The operating threshold T can be a linear distance, an arc length, and/or any other suitable measurement. The operating threshold T can, for example, be a distance in a widthwise direction perpendicular to the rear frame longitudinal axis M of up to 1 mm, 5 mm, 10 mm, 25 mm, 50 mm, 100 mm, 150 mm, 200 mm, 300 mm, 400 mm, 500 mm, or any distance therebetween.

Referring next to FIG. 1C, the orientation of the blade 108 has been adjusted such that the second (leading) edge 108*b* is within the operating threshold T. In the illustrated embodiment, for example, the frame actuator 106 has been actuated (e.g., articulated, engaged, triggered, etc.) to rotate the front frame 104 relative to the rear frame 102. Rotating the front frame 104 can rotate the front frame longitudinal axis F to at a second frame angle $\Theta_{FM2}$ relative to the rear frame longitudinal axis M. Accordingly, actuating the frame actuator 106 can move the second edge 108*b* from a first position (FIG. 1B) outside the operating threshold T to a second position within the operating threshold T. This can involve, for example, actuating the frame actuator 106 to rotate the front frame 104 relative to the rear frame. In some embodiments, the second edge 108*b* can be moved to the second position while the blade angle $\Theta_B$ is held constant or fixed (e.g., not adjusted).

The amount or degree to which the front frame 104 is rotated or articulated can correspond to the difference between the second frame angle $\Theta_{FM2}$ and the first frame angle $\Theta_{FM1}$. This can be determined (e.g., automatically determined) based on a configuration of the machine 100 and/or a dimension(s) of one or more components thereof, as described previously. This is described in greater detail below and with reference to FIGS. 2A-2B.

In at least some embodiments, the machine 100, and/or one or more components thereof, can include a plurality of sensors (not shown). The sensors can be configured to measure, for example, the position and/or orientation of each of the components relative to the rear frame 102 and/or rear frame longitudinal axis M. For example, the frame actuator 106 can include a first sensor configured to measure one or more frame angles (e.g., $\Theta_{FM1}$, $\Theta_{FM2}$, etc.) and/or the blade actuator 110 can include a second sensor configured to measure one or more blade angles (e.g., $\Theta_B$). In at least some embodiments, the one or more dimensions of the machine 100 can be known or predetermined. This can include, for example, the front frame length and/or the blade length of the machine 100. Accordingly, the distance D (FIG. 1B) can be geometrically determined in accordance with known mathematical principles (e.g., automatically determined) based on the plurality of sensors and/or the one or more dimensions of the machine 100. Similarly, the degree of articulation can be determined (e.g., automatically determined) based on the plurality of sensors, the dimensions of the machine 100, and/or the threshold T.

FIGS. 2A and 2B are top views of a machine 200 comprising a blade 208 and configured in accordance with select embodiments of the present technology. The machine 200 can be generally similar or the same as the machine 100 of FIGS. 1A-1C. Accordingly, like numbers are used to identify similar components (e.g., blade 208 versus blade 108 of FIGS. 1A-1C), and a description of the machine 200 will be limited to those features that differ from the machine 100 of FIGS. 1A-1C and/or are necessary for context.

Referring to FIGS. 2A and 2B together, in the illustrated embodiment the machine 200 is a motor grader. The blade 208 can be a reversible blade, e.g., configured to rotate in a first (e.g., right) direction R, and a second (e.g., left) direction L. In some embodiments, the blade 208 can rotate at least 5 degrees, 10 degrees, 15 degrees, 20 degrees, 30 degrees, 45 degrees, and/or any degree there between in the first direction R and/or the second direction L. In some embodiments, the blade 208 can be configured to at least partially remove or dislodge one or more materials (e.g., dirt, gravel, snow, sand, and/or other material) from a surface. In at least some embodiments, for example, the blade 208 can be configured to at least partially remove snow form a road surface. In at least some embodiments, for example, the blade 208 can be configured to at least partially level or smooth a dirt surface. As best seen in FIG. 2B, the rear frame longitudinal axis M can be a centerline of the rear frame 202 such that, when the second (e.g., leading) edge 208*b* is in the second position (e.g., within the operating threshold T), the second edge 208*b* can be generally or substantially aligned with the centerline of the rear frame 202.

The distance D can be determined (e.g., automatically determined) based on a configuration of the machine 200 and/or a dimension(s) of one or more components thereof. The distance D can, for example, be determined using equation (1) below:

$$D=(P_{C1x}-L_F)\sin(\theta_{FM}+\theta_B)+P_{C1y}\cos(\theta_{FM}+\theta_B)+L_F\sin\theta_{FM} \quad (1)$$

where $P_{C1x}$ is a first position of the second (leading) edge 208*b* in an x direction, PC1y is a second position of the second (leading) edge 208*b* in a y direction, $L_F$ is a distance between a first articulation point or pin $P_A$ in the frame actuator 206 and a second articulation point or pin $P_B$ in the blade actuator 210, $\Theta_{FM}$ is the angle of front frame longitudinal axis F relative to the rear frame longitudinal axis M, and $\Theta_B$ is the angle of the blade 208 relative to the front frame longitudinal axis F. Accordingly, if the distance D is greater than the operating threshold T, the machine 200 can actuate the frame actuator 106 to rotate or articulate the front frame 204 and move the second (leading edge 208*b*) to the second position within the operating threshold.

The amount or degree to which the front frame 204 is rotated or articulated can be determined (e.g., automatically determined) based on a configuration of the machine 100 and/or a dimension(s) of one or more components thereof. For example, the amount of articulation $\Theta_{FM2}$ (FIG. 1C) can be determined using equation (2) below:

$$\theta_{FM2}=\theta_{FM}+\Delta\theta_{FM}=\theta_{FM}+\tan^{-1}\left(-\frac{(P_{C1x}-L_F)\sin(\theta_{FM}+\theta_B)+P_{C1y}\cos(\theta_{FM}+\theta_B)+L_F\sin\theta_{FM}}{(P_{C1x}-L_F)\cos(\theta_{FM}+\theta_B)-P_{C1y}\sin(\theta_{FM}+\theta_B)+L_F\cos\theta_{FM}}\right) \quad (2)$$

Figure 3:
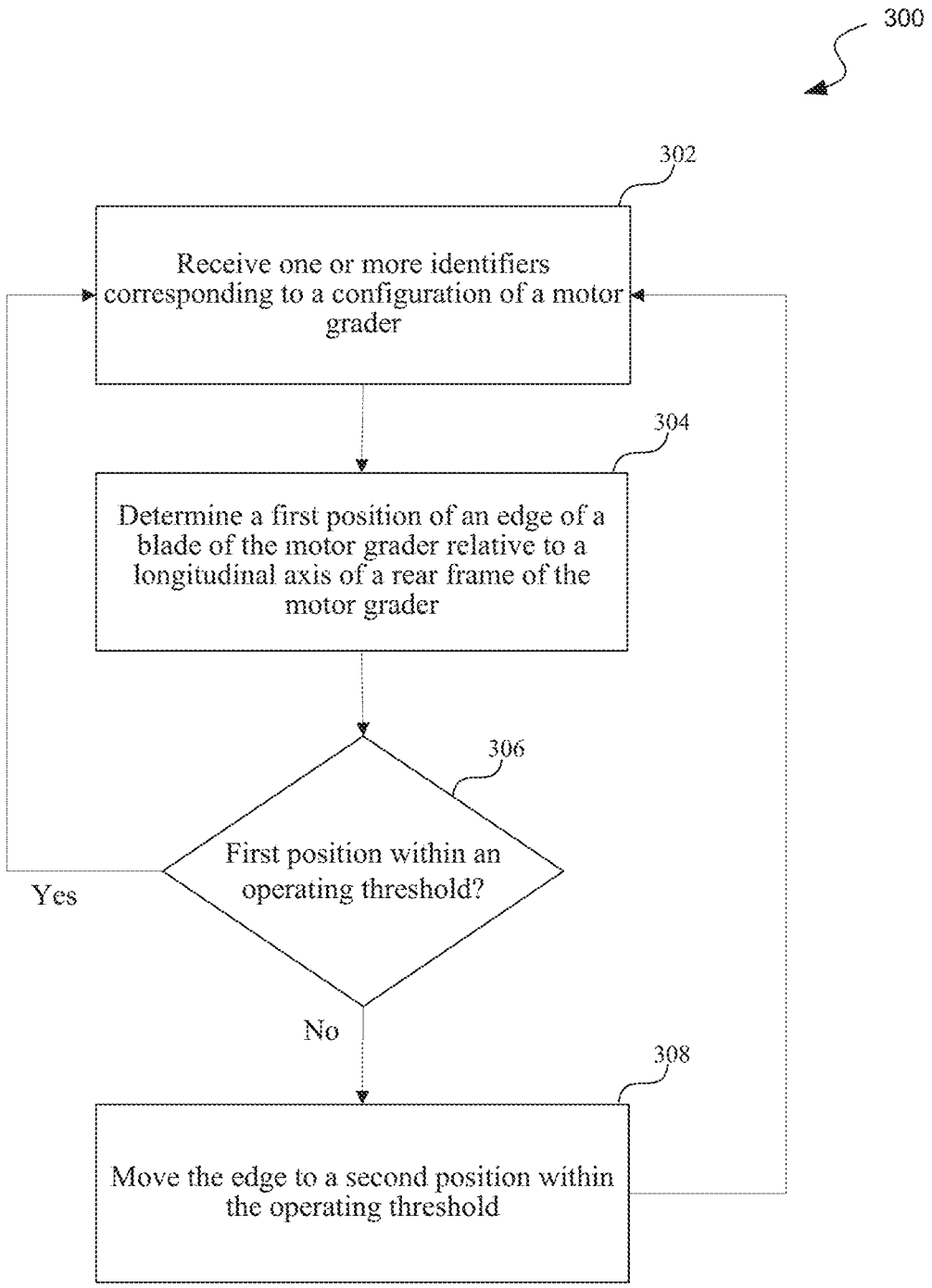
FIG. 3 is a flow diagram illustrating a method for automatically articulating a blade in accordance with select embodiments of the present technology.

FIG. 3 is a flow diagram illustrating a method 300 (e.g., a computer-implemented method 300) for automatically articulating a blade in accordance with select embodiments of the present technology. At step 302, the method 300 includes receiving one or more identifiers corresponding to a configuration of a machine. The machine can be generally similar to or the same as the machine 100 of FIG. 1 and/or the machine 200 of FIG. 2. The configuration of the machine can comprise one or more dimensions of the machine and/or the output of the one or more sensors as described previously and with reference to FIGS. 1A-2. In at least some embodiments, for example, the one or more identifiers can include a front frame angle identifier, a blade angle identifier, a machine mode identifier, a machine speed identifier, a machine transmission gear identifier, and/or one or more dimensional identifiers of the machine.

The front frame angle identifier can correspond to the front frame angle $\Theta_{FM}$ (FIGS. 1A-1C). In at least some embodiments, the front frame angle identifier can be determined based on one or more sensors configured to measure the angle of the front frame 104 (FIGS. 1A-1C) relative to the rear frame (FIGS. 1A-1C) and/or monitor the operation of the frame actuator 106 (FIGS. 1A-1C).

The blade angle identifier can correspond to the blade angle $\Theta_B$ (FIGS. 1A-1C). In at least some embodiments, the blade angle identifier can be determined by one or more sensor configured to measure the angle of the blade 108 (FIGS. 1A-1C) relative to a reference orientation $B_0$ (FIGS. 1A-1C) and/or the front frame longitudinal axis F (FIGS. 1A-1C).

The machine mode identifier can correspond to a mode of the machine. In at least some embodiments, the machine can have one or more operating modes, and the method 300 can include adjusting the articulation of the blade based on the one or more operating modes. In at least some embodiments, for example, the machine can have a first (e.g., active, snow removal on, etc.) mode where the machine is configured to automatically adjust the blade position (e.g., as described previously), and a second (e.g., inactive, snow removal off, etc.) mode where the machine does not automatically adjust the blade position. Accordingly, if in step 302 one of the one or more identifiers corresponds to the second mode, the method 300 can pause or remain at step 302 until an identifier corresponding to the first mode is received.

The machine speed identifier can correspond to a speed at which the machine is traveling. As described in greater detail below, the method 300 can include adjusting one or more aspects of the blade articulation based on the machine speed identifier.

The machine transmission gear identifier can correspond to a gear in which a transmission of the machine is operating. As described in greater detail below, the method 300 can include adjusting one or more aspects of the blade articulation based on the machine transmission gear identifier.

The one or more dimensional identifiers can correspond to any of the measurements or dimensions of the machine described previously, such as the front frame length identifier that corresponds to the front frame length and/or a blade length identifier that corresponds to the blade length.

In at least some embodiments, the one or more identifiers can further include an operating threshold identifier. The operating threshold identifier can correspond to the operating threshold T of FIGS. 1B and 1C. In at least some embodiments, the one or more identifiers can further include a rear frame longitudinal axis identifier. The rear frame longitudinal axis identifier can correspond to the rear frame longitudinal axis M of FIGS. 1A-2. In at least some embodiments, the one or more identifiers can further include a front frame longitudinal axis identifier. The front frame longitudinal axis identifier can correspond to the front frame longitudinal axis F of FIGS. 1A-1C.

In some embodiments, at least one of the one or more identifiers can be predetermined (e.g., pre-programmed) based on the configuration of the machine. This can include at least one of the one or more dimensional identifiers, the operating threshold identifier, the rear frame longitudinal axis identifier, the front frame longitudinal axis identifier, and/or any other identifier described herein. In at least some embodiments, for example, the one or more dimensional identifiers can be stored in a database, and step 302 can include accessing the database to determine the one or more dimensional identifiers.

At step 304, the method 300 can further include determining a first position of an edge of the blade relative to the longitudinal axis of a rear frame of the machine (e.g., the rear frame longitudinal axis M of FIGS. 1A-1C). The edge of the blade can be a leading edge, such as the second (e.g., leading) edge 108*b* of FIGS. 1A-1C. The first position can be determined (e.g., automatically determined) based on the one or more identifiers of step 302, e.g., and as described previously with reference to FIGS. 1A-1C.

At step 306, the method 300 can further include determining whether the first position of step 304 is within the operating threshold. If the first position is within the operating threshold, then the method 300 can return to step 302, and can include repeating one or more of the steps 302-306. If the first position is outside (e.g., beyond, not within, etc.) the operating threshold, then the method 300 can continue to step 308.

At step 308, the method 300 can further include moving the edge to a second position within the operating threshold. In some embodiments, moving the edge to the second position can include determining an amount of articulation and/or rotating a front frame of the machine, as described previously and with reference to FIGS. 1A-1C. In some embodiments, rotating the front frame can include actuating a frame actuator, as described previously and with reference to FIGS. 1A-1C.

In some embodiments, the step 308 can further include adjusting a rate or velocity of the articulation based on the one or more identifiers. For example, the rate or velocity of the blade articulation can be adjusted based on the machine speed identifier, such that the articulation rate can be zero (e.g., deactivated) when the machine speed is zero (e.g., stationary), the articulation rate can be relatively high (e.g., at least 10 degrees per second) when the machine speed is low (e.g., less than 12 kph (8 mph)), and/or the articulation rate can be relatively low (e.g., less than 5 degrees per second) when the machine speed is high (e.g., at least 12 kph (8 mph)). In at least some embodiments, the blade articulation can be inhibited or prevented when the machine speed exceeds a predetermined threshold (e.g., at least 27 kph (17 mph)). Additionally, in at least some embodiments, the rate or velocity of articulation can correspond to the machine transmission gear identifier. For example, the articulation rate can be zero (e.g., articulation deactivated) when the machine transmission gear is neutral, the articulation rate can be relatively high (e.g., at least 10 degrees per second) when the machine transmission gear is low (e.g., 2 forward or 1 reverse), and/or the articulation rate can be relatively low (e.g., less than 12 kph (8 mph)) when the machine transmission gear is high (e.g., 4 forward or 3 reverse). In at least some embodiments blade articulation can be inhibited or prevented or limited to a maximum angle (e.g. 5.5 degrees max) when the machine transmission gear exceeds a predetermined threshold (e.g., 5 forward or 4 reverse).

In some embodiments, once the edge is in the second position, the method 300 can further include returning to step 302 and repeating one or more of the steps 302-308.

Figure 4:
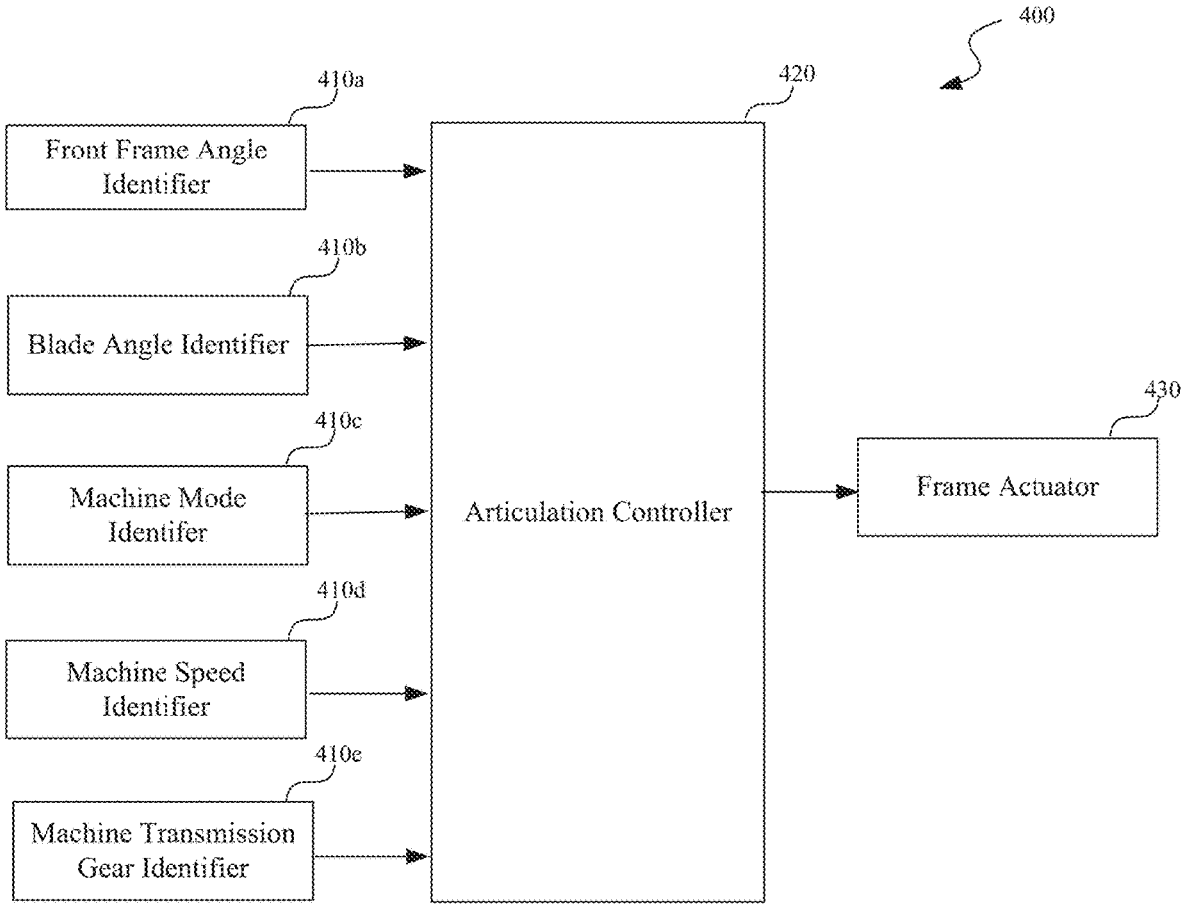
FIG. 4 is a block diagram illustrating an exemplary system configured in accordance with select embodiments of the present technology.

FIG. 4 is a schematic illustration of a system 400 configured in accordance with select embodiments of the present technology. In at least some embodiments, the system 400 can be part of a machine, such as the machine 100 of FIGS. 1A-1C and/or the machine 200 of FIG. 2. In at least some embodiments, the system 400 can be used to perform one or more steps of the method 300 of FIG. 3. Accordingly, a description of the machine 100 of FIGS. 1A-1C, the machine 200 of FIG. 2, and/or the method 300 of FIG. 3 applies equally to the system 400.

Referring to FIG. 4, the system 400 can include an articulation controller 420 configured to receive one or more inputs 410. Individual ones of the inputs 410 can be generally similar to or the same as individual ones of the one or more identifiers of step 302 of the method 300. In the illustrated embodiment, for example, the one or more inputs 410 include a front frame angle identifier 410*a*, a blade angle identifier 410*b*, a machine mode identifier 410*c*, a machine speed identifier 410*d*, and a machine transmission gear identifier 410*e*. Based at least partially on the one or more inputs 410, the articulation controller 420 can be configured to determine (e.g., automatically determine) the first position of the edge (e.g., the leading edge) of the blade relative to the operating threshold (e.g., steps 304, 306 of the method 300), and/or the amount of articulation to move the edge from the first position to the second position (e.g., step 308).

The system 400 can further include a frame actuator 430 that can be generally similar to or the same as the frame actuator 106 of FIGS. 1A-1C. Once the articulation controller 420 has determined first position of the edge and/or the determined amount of articulation, the articulation controller 420 can be send a signal to the frame actuator 430 to actuate the frame actuator 430, e.g., to rotate the front frame 104 (FIGS. 1A-2) by the determined amount. As described previously, actuating the frame actuator 430 can move the edge from the first position to the second position.

It is expected that machines and/or systems configured in accordance with embodiments of the present technology represent an improvement over traditional machines and/or systems. For example, when the leading edge of the blade 108 is within the operating threshold T, the machine 100 is expected to have improved load distribution and/or a reduced risk of the sliding. This can make the machine 100 easier and/or safer to operate compared to traditional machines and/or systems. It is additionally expected that aligning the leading edge of the blade 108 with the rear frame longitudinal axis M will reduce the amount of side draft caused by the blade 108, increase a cutting angle of the blade 108, and/or otherwise improve the performance of the machine 100 compared to traditional machines and/or systems.

Suitable System

The techniques disclosed herein can be embodied as special-purpose hardware (e.g., circuitry), as programmable circuitry appropriately programmed with software and/or firmware, or as a combination of special-purpose and programmable circuitry. Hence, embodiments may include a machine-readable medium having stored thereon instructions which may be used to cause a computer, a microprocessor, processor, and/or microcontroller (or other electronic devices) to perform a process. The machine-readable medium may include, but is not limited to, optical disks, compact disc read-only memories (CD-ROMs), magneto-optical disks, ROMs, random access memories (RAMs), erasable programmable read-only memories (EPROMs), electrically erasable programmable read-only memories (EEPROMs), magnetic or optical cards, flash memory, or other type of media/machine-readable medium suitable for storing electronic instructions.

Figure 5:
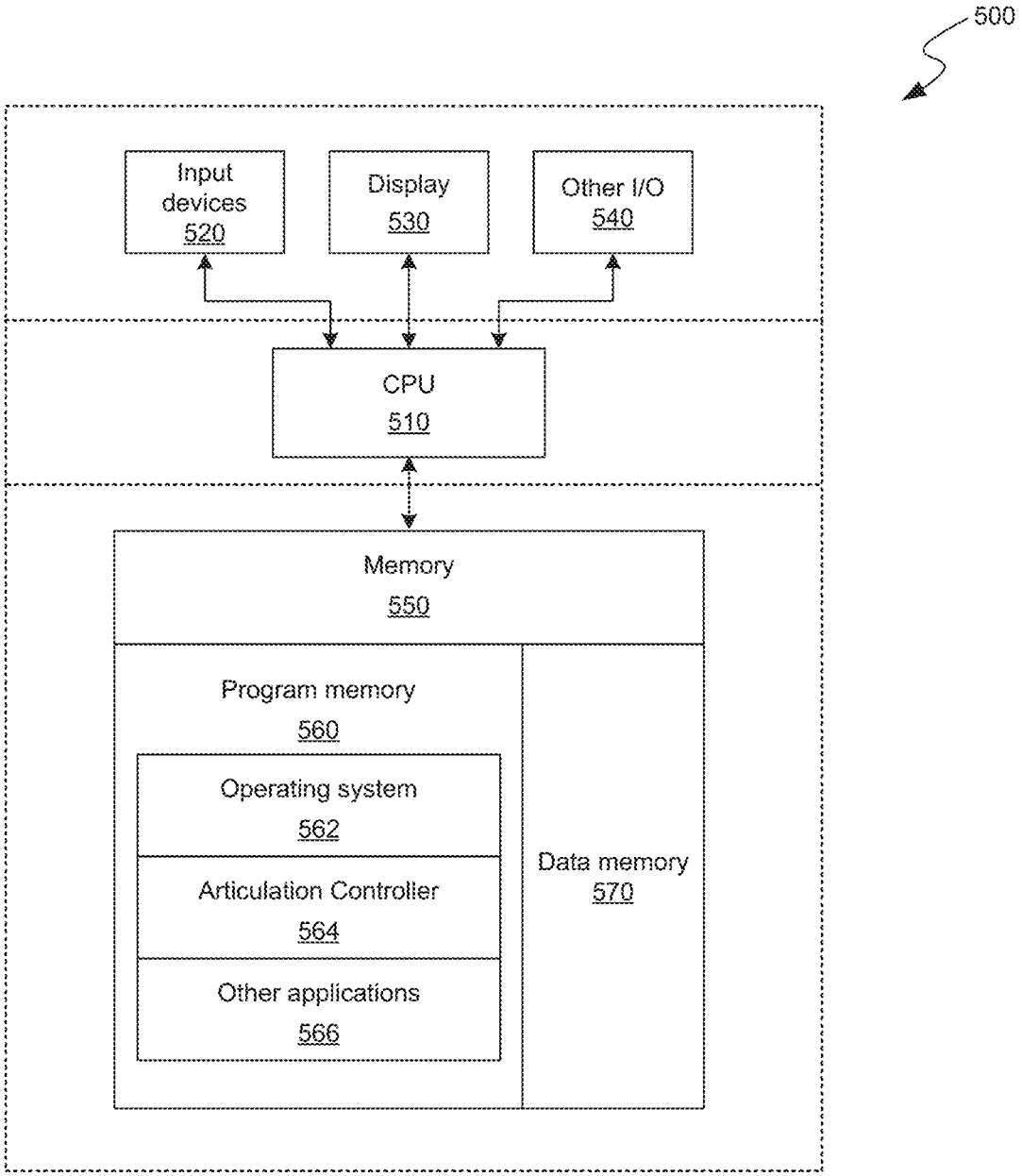
FIG. 5 is a block diagram illustrating an overview of devices on which some implementations can operate.

Several implementations are discussed below in more detail in reference to the figures. FIG. 5 is a block diagram illustrating an overview of devices on which some implementations of the disclosed technology can operate. The devices can comprise hardware components of a system or device 500 that performs scheduling of machine operation functions, for example. System 500 can include one or more input devices 520 that provide input to the CPU (processor) 510, notifying it of actions. The actions are typically mediated by a hardware controller that interprets the signals received from the input device and communicates the information to the CPU 510 using a communication protocol. Input devices 520 include, for example, a mouse, a keyboard, a touchscreen, an infrared sensor, a touchpad, a wearable input device, a camera- or image-based input device, a microphone, or other user input devices.

CPU 510 can be a single processing unit or multiple processing units in a device or distributed across multiple devices. CPU 510 can be coupled to other hardware devices, for example, with the use of a bus, such as a PCI bus or SCSI bus. The CPU 510 can communicate with a hardware controller for devices, such as for a display 530. Display 530 can be used to display text and graphics. In some examples, display 530 provides graphical and textual visual feedback to a user. In some implementations, display 530 includes the input device as part of the display, such as when the input device is a touchscreen or is equipped with an eye direction monitoring system. In some implementations, the display is separate from the input device. Examples of display devices are: an LCD display screen; an LED display screen; a projected, holographic, or augmented reality display (such as a heads-up display device or a head-mounted device); and so on. Other I/O devices 540 can also be coupled to the processor, such as a network card, video card, audio card, USB, FireWire or other external device, sensor, camera, printer, speakers, CD-ROM drive, DVD drive, disk drive, or Blu-Ray device.

In some implementations, the device 500 also includes a communication device capable of communicating wirelessly or wire-based with a network node. The communication device can communicate with another device or a server through a network using, for example, TCP/IP protocols. Device 500 can utilize the communication device to distribute operations across multiple network devices.

The CPU 510 can have access to a memory 550. A memory includes one or more of various hardware devices for volatile and non-volatile storage, and can include both read-only and writable memory. For example, a memory can comprise random access memory (RAM), CPU registers, read-only memory (ROM), and writable non-volatile memory, such as flash memory, hard drives, floppy disks, CDs, DVDs, magnetic storage devices, tape drives, device buffers, and so forth. A memory is not a propagating signal divorced from underlying hardware; a memory is thus non-transitory. Memory 550 can include program memory 560 that stores programs and software, such as an operating system 562, Articulation Controller 564 (which can be generally similar to or the same as the articulation controller 420 of FIG. 4 and/or may include instructions for carrying out the methods of automatic blade articulation disclosed herein), and other application programs 566. Memory 550 can also include data memory 570 that can include database information, etc., which can be provided to the program memory 560 or any element of the device 500.

Some implementations can be operational with numerous other general purpose or special purpose computing system environments or configurations. Examples of well-known computing systems, environments, and/or configurations that may be suitable for use with the technology include, but are not limited to, personal computers, server computers, handheld or laptop devices, cellular telephones, mobile phones, wearable electronics, gaming consoles, tablet devices, multiprocessor systems, microprocessor-based systems, set-top boxes, programmable consumer electronics, network PCs, minicomputers, mainframe computers, distributed computing environments that include any of the above systems or devices, or the like.

Figure 6:
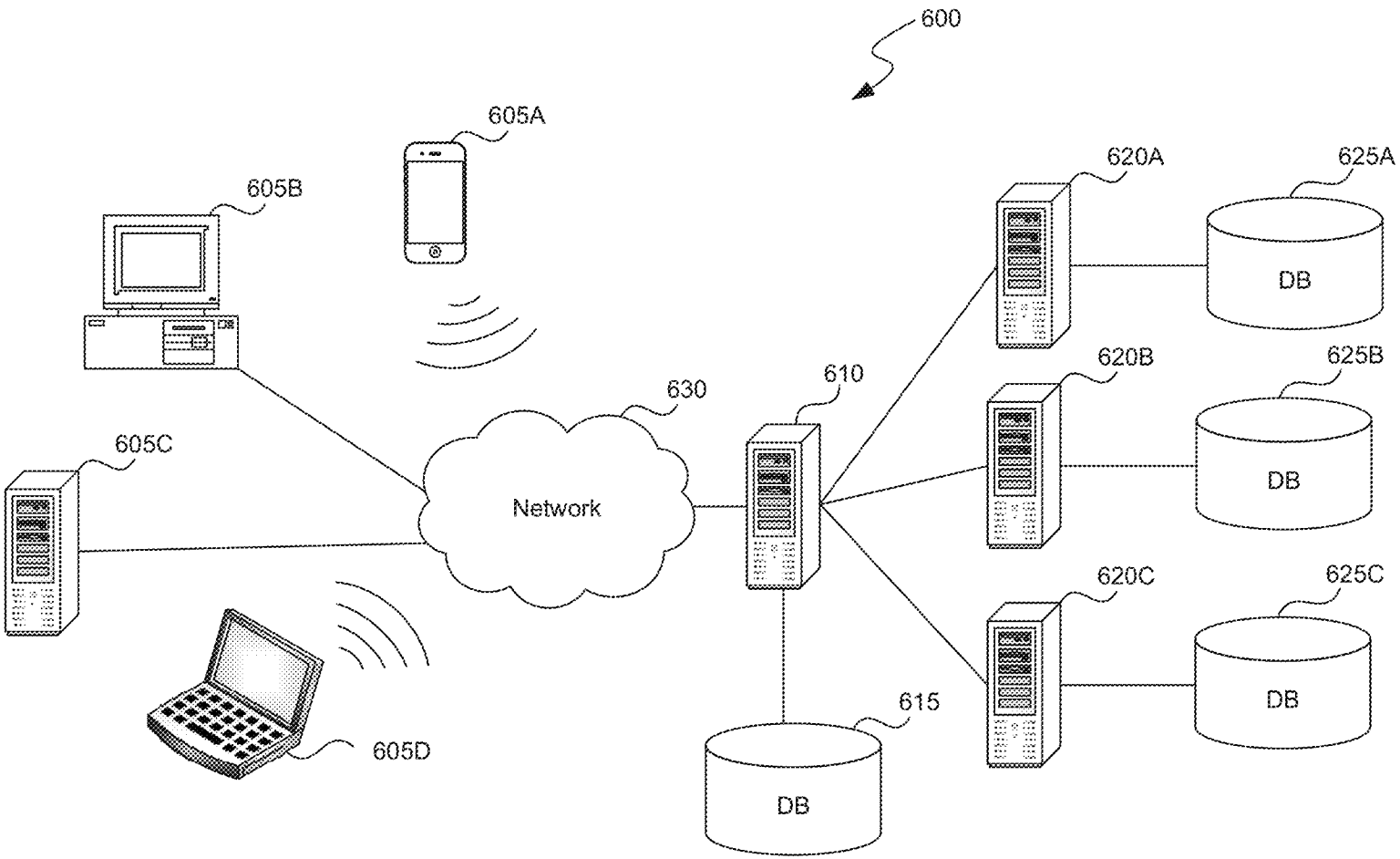
FIG. 6 is a block diagram illustrating an overview of an environment in which some implementations can operate.

FIG. 6 is a block diagram illustrating an overview of an environment 600 in which some implementations of the disclosed technology can operate. Environment 600 can include one or more client computing devices 605A-D, examples of which can include device 500. Client computing devices 605A-D can operate in a networked environment using logical connections through network 630 to one or more remote computers, such as a server computing device 610. In some embodiments, one or more aspects of the environment 600, such as one or more of the client computing devices 605A-D, can be included in the machine 100 (FIG. 1) and/or coupled (e.g., communicatively, operably, etc.) to one or more components thereof.

In some implementations, server computing device 610 can be an edge server that receives client requests and coordinates fulfillment of those requests through other servers, such as servers 620A-C. Server computing devices 610 and 620 can comprise computing systems, such as the device 500. Though each server computing device 610 and 620 is displayed logically as a single server, server computing devices can each be a distributed computing environment encompassing multiple computing devices located at the same or at geographically disparate physical locations. In some implementations, each server computing device 620 corresponds to a group of servers.

Client computing devices 605 and server computing devices 610 and 620 can each act as a server or client to other server/client devices. Server 610 can connect to a database 615. Servers 620A-C can each connect to a corresponding database 625A-C. As discussed above, each server 620 can correspond to a group of servers, and each of these servers can share a database or can have their own database. Databases 615 and 625 can warehouse (e.g., store) information, such as one or more dimensions of the machine 100 of FIGS. 1A-1C. Though databases 615 and 625 are displayed logically as single units, databases 615 and 625 can each be a distributed computing environment encompassing multiple computing devices, can be located within their corresponding server, or can be located at the same or at geographically disparate physical locations.

Network 630 can be a local area network (LAN) or a wide area network (WAN), but can also be other wired or wireless networks. Network 630 may be the Internet or some other public or private network. Client computing devices 605 can be connected to network 630 through a network interface, such as by wired or wireless communication. While the connections between server 610 and servers 620 are shown as separate connections, these connections can be any kind of local, wide area, wired, or wireless network, including network 630 or a separate public or private network.

Figure 7:
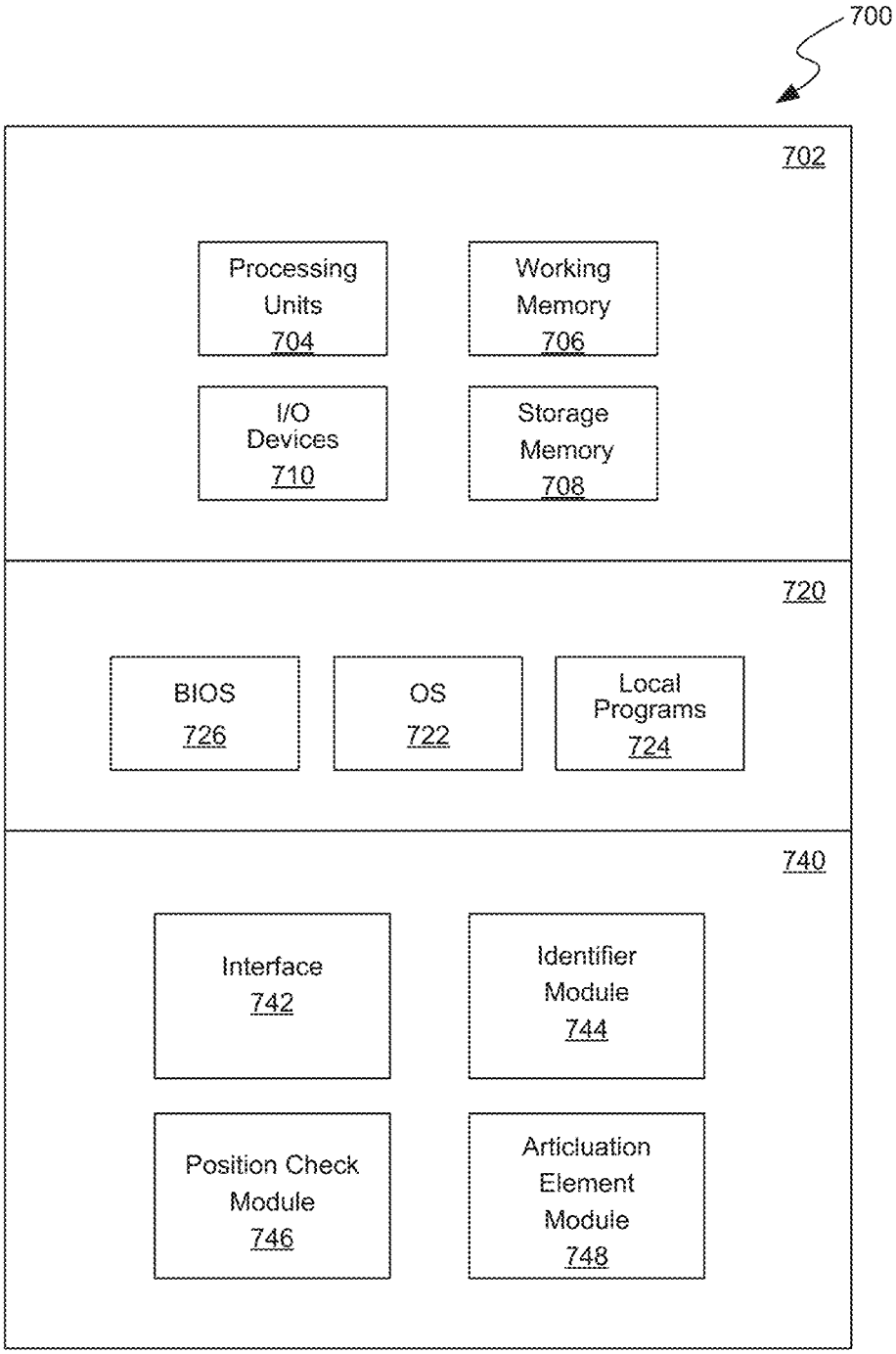
FIG. 7 is a block diagram illustrating elements which, in some implementations, can be used in a system employing the disclosed technology.

FIG. 7 is a block diagram illustrating elements 700 which, in some implementations, can be used in a system employing the disclosed technology. The elements 700 include hardware 702, general software 720, and specialized elements 740. As discussed above, a system implementing the disclosed technology can use various hardware, including processing units 704 (e.g., CPUs, GPUs, APUs, etc.), working memory 706, storage memory 708, and input and output devices 710. Elements 700 can be implemented in a client computing device such as client computing devices 605 or on a server computing device, such as server computing device 610 or 620.

General software 720 can include various applications, including an operating system 722, local programs 724, and a basic input output system (BIOS) 726. Specialized element 740 can be subelements of a general software application 720, such as local programs 724, which may include the Articulation Controller 564 (see FIG. 5 and description above). Specialized elements 740 can include an Identifier Module 744, a Position Check Module 746, an Articulation Element Module 748, and components that can be used for transferring data and controlling the specialized components, such as interface 742. In some implementations, elements 700 can be in a computing system that is distributed across multiple computing devices or can be an interface to a server-based application executing one or more of specialized elements 740.

Those skilled in the art will appreciate that the components illustrated in FIGS. 5-7 described above may be altered in a variety of ways. For example, the order of the logic may be rearranged, sub steps may be performed in parallel, illustrated logic may be omitted, other logic may be included, etc. In some implementations, one or more of the components described above can execute one or more of the processes described herein.

INDUSTRIAL APPLICABILITY

In some embodiments, systems for automatically articulating an industrial machine blade can include an articulation controller 420 (FIG. 4), 564 (FIG. 5) comprising an Identifier Module 744, a Position Check Module 746 and an Articulation Element Module 748 (FIG. 7). In operation, the Identifier Module 744 can collect and store individual ones of the one or more identifiers (see step 302 in FIG. 3). The Position Check Module 746 can determine the first position of the edge (e.g., the leading edge) of the blade relative to a rear frame longitudinal axis (see step 304 in FIG. 3). The Position Check Module 746 can additionally determine whether the first position is within the operating threshold (see step 306 in FIG. 3). Based on the output(s) of the Position Check Module 746, the Articulation Element Module 748 can determine an amount or degree of articulation, and can additionally actuate the frame actuator 106 (FIGS. 1A-1C) to move the edge from the first position to a second position within the operating threshold (step 308 in FIG. 3). General software 720 (see FIG. 7) may include instructions to repeat steps 302, 304, 306 and/or 308 of the method 300 (see FIG. 3) at selected increments of time to continually or periodically update the position of the edge of the blade relative to the operating threshold and/or the articulation of the front frame. The disclosed technology, therefore, provides automatic blade articulation, which can provide improved operation compared to traditional machines. In particular, the disclosed technology can automatically maintain the position of the leading edge of blade within the operating threshold to improve the load distribution on the machine, blade, and/or front frame; reduce the risk of the machine sliding; and/or otherwise improve control of the machine.

CONCLUSION

The above description and drawings are illustrative and are not to be construed as limiting. Numerous specific details are described to provide a thorough understanding of the disclosure. However, in some instances, well-known details are not described in order to avoid obscuring the description. Further, various modifications may be made without deviating from the scope of the embodiments.

Reference in this specification to "one embodiment" or "an embodiment" means that a particular feature, structure, or characteristic described in connection with the embodiment is included in at least one embodiment of the disclosure. The appearances of the phrase "in one embodiment" (or the like) in various places in the specification are not necessarily all referring to the same embodiment, nor are separate or alternative embodiments mutually exclusive of other embodiments. Moreover, various features are described which may be exhibited by some embodiments and not by others. Similarly, various requirements are described which may be requirements for some embodiments but not for other embodiments.

The terms used in this specification generally have their ordinary meanings in the art, within the context of the disclosure, and in the specific context where each term is used. It will be appreciated that the same thing can be said in more than one way. Consequently, alternative language and synonyms may be used for any one or more of the terms discussed herein, and any special significance is not to be placed upon whether or not a term is elaborated or discussed herein. Synonyms for some terms are provided. A recital of one or more synonyms does not exclude the use of other synonyms. The use of examples anywhere in this specification, including examples of any term discussed herein, is illustrative only and is not intended to further limit the scope and meaning of the disclosure or of any exemplified term. Likewise, the claims are not to be limited to various embodiments given in this specification. Unless otherwise defined, all technical and scientific terms used herein have the same meaning as commonly understood by one of ordinary skill in the art to which this disclosure pertains. In the case of conflict, the present document, including definitions, will control.

As used herein, the term "and/or" when used in the phrase "A and/or B" means "A, or B, or both A and B." A similar manner of interpretation applies to the term "and/or" when used in a list of more than two terms.

The above detailed description of embodiments of the technology are not intended to be exhaustive or to limit the technology to the precise forms disclosed above. Although specific embodiments of, and examples for, the technology are described above for illustrative purposes, various equivalent modifications are possible within the scope of the technology as those skilled in the relevant art will recognize. For example, although steps are presented in a given order, alternative embodiments may perform steps in a different order. The various embodiments described herein may also be combined to provide further embodiments.

From the foregoing, it will be appreciated that specific embodiments of the technology have been described herein for purposes of illustration, but well-known structures and functions have not been shown or described in detail to avoid unnecessarily obscuring the description of the embodiments of the technology. Where the context permits, singular or plural terms may also include the plural or singular term, respectively.

As used herein, the terms "connected," "coupled," or any variant thereof, means any connection or coupling, either direct or indirect, between two or more elements; the coupling of connection between the elements can be physical, logical, or a combination thereof. Additionally, the words "herein," "above," "below," and words of similar import, when used in this application, shall refer to this application as a whole and not to any particular portions of this application. Where the context permits, words in the above Detailed Description using the singular or plural number may also include the plural or singular number respectively. Additionally, the term "comprising" is used throughout to mean including at least the recited feature(s) such that any greater number of the same feature and/or additional types of other features are not precluded, unless context suggests otherwise. It will also be appreciated that specific embodiments have been described herein for purposes of illustration, but that various modifications may be made without deviating from the technology. Further, while advantages associated with some embodiments of the technology have been described in the context of those embodiments, other embodiments may also exhibit such advantages, and not all embodiments need necessarily exhibit such advantages to fall within the scope of the technology. Accordingly, the disclosure and associated technology can encompass other embodiments not expressly shown or described herein.

What is claimed is:

1. A method for automatically adjusting a motor grader, the method comprising:

receiving one or more identifiers corresponding to a configuration of the motor grader, wherein the motor grader comprises:

a rear frame having a rear frame axis;

a front frame having a first front frame end portion, a front frame axis, and a second front frame end portion spaced apart from the first front frame end portion along the front frame axis, wherein:

the first front frame end portion includes a blade actuator, the second front frame end portion is pivotably coupled to the rear frame;

a blade rotatably coupled to the first front frame end portion and operably connected to the blade actuator, wherein the blade includes a leading edge; and a frame actuator connected to the rear frame and the front frame, the frame actuator being configured to change an articulation angle between the rear frame axis and the front frame axis;

determining, based at least in part on the one or more identifiers, a position of the leading edge relative to the rear frame axis; and if the position is not within an operating threshold, causing the frame actuator to change the articulation angle to move the leading edge to within the operating threshold.

2. The method of claim 1 wherein the blade includes a trailing edge spaced apart from the leading edge along a blade axis, and wherein determining a position of the leading edge further comprises:

determining a first angle of the blade axis relative to the front frame axis, and determining a second angle of the front frame axis relative to the rear frame axis.

3. The method of claim 2, wherein:

the motor grader further comprises a plurality of sensors, the plurality of sensors including a first sensor configured to measure the first angle of the blade axis relative to the front frame axis and a second sensor configured to measure the second angle of the front frame axis relative to the rear frame axis, wherein the determining the first angle includes determining, using the first sensor, the first angle, and wherein the determining the second angle includes determining, using the second sensor, the second angle.

4. The method of claim 1 wherein causing the frame actuator to change the articulation angle includes using the frame actuator to pivot the front frame and the front frame axis from an initial angle relative to the rear frame axis where the position of the leading edge is not within the operating threshold to a final angle relative to the rear frame axis where the position of the leading edge is within the operating threshold.

5. The method of claim 4 wherein the final angle is less than the initial angle.

6. The method of claim 1 wherein the one or more identifiers include at least one of: a front frame angle identifier, a front frame length identifier, a blade angle identifier, a blade length identifier, a blade width identifier, a blade pitch identifier, a motor grader mode identifier, a motor grader speed identifier, and/or a motor grader transmission gear identifier.

7. The method of claim 1 wherein the operating threshold is a distance from the front frame axis of up to 1 mm, up to 5 mm, up to 10 mm, up to 25 mm, up to 50 mm, up to 100 mm, up to 150 mm, up to 200 mm, up to 300 mm, up to 400 mm, or up to 500 mm.

8. A motor grader, comprising:

a rear frame having a rear frame axis;

a front frame having a first front frame end portion, a front frame axis, and a second front frame end portion spaced apart from the first front frame end portion along the front frame axis, wherein:

the first front frame end portion includes a blade actuator, the second front frame end portion is pivotably coupled to the rear frame;

a blade rotatably coupled to the first front frame end portion and operably connected to the blade actuator, wherein the blade includes a leading edge; and a frame actuator connected to the rear frame and the front frame, the frame actuator being configured to change an articulation angle between the rear frame axis and the front frame axis;

one or more processors; and one or more memory devices having stored thereon instructions that when executed by the one or more processors cause the one or more processors to:

receive one or more identifiers corresponding to a configuration of the motor grader determine, based at least in part on the one or more identifiers, a position of the leading edge relative to the rear frame axis; and if the position is not within an operating threshold, cause the frame actuator to change the articulation angle to move the leading edge to within the operating threshold.

9. The motor grader of claim 8 wherein the blade further includes a trailing edge spaced apart from the leading edge along a blade axis, and wherein determining a position of the leading edge further comprises:

determining a first angle of the blade axis relative to the front frame axis, and determining a second angle of the front frame axis relative to the rear frame axis.

10. The motor grader of claim 9, wherein:

the motor grader further comprises a plurality of sensors, the plurality of sensors including a first sensor configured to measure the first angle of the blade axis relative to the front frame axis and a second sensor configured to measure the second angle of the front frame axis relative to the rear frame axis, determining the first angle includes determining, using the first sensor, the first angle, and determining the second angle includes determining, using the second sensor, the second angle.

11. The motor grader of claim 8 wherein causing the frame actuator to change the articulation angle includes using the frame actuator to pivot the front frame and the front frame axis from an initial angle relative to the rear frame axis where the position of the leading edge is not within the operating threshold to a final angle relative to the rear frame axis where the position of the leading edge is within the operating threshold.

12. The motor grader of claim 11 wherein the final angle is less than the initial angle.

13. The motor grader of claim 8 wherein the one or more identifiers include at least one of: a front frame angle identifier, a front frame length identifier, a blade angle identifier, a blade length identifier, a blade width identifier, a blade pitch identifier, a motor grader mode identifier, a motor grader speed identifier, and/or a motor grader transmission gear identifier.

14. The motor grader of claim 8 wherein the operating threshold is a distance from the front frame axis of up to 1 mm, up to 5 mm, up to 10 mm, up to 25 mm, up to 50 mm, up to 100 mm, up to 150 mm, up to 200 mm, up to 300 mm, up to 400 mm, or up to 500 mm.

15. A system for automatically adjusting a blade assembly, the system comprising:

a motor grader comprising:

a rear frame having a rear frame axis;

a front frame having a first front frame end portion, a front frame axis, and a second front frame end portion spaced apart from the first front frame end portion along the front frame axis, wherein:

the first front frame end portion includes a blade actuator, the second front frame end portion is pivotably coupled to the rear frame;

a blade rotatably coupled to the first front frame end portion and operably connected to the blade actuator, wherein the blade includes a leading edge, a frame actuator connected to the rear frame and the front frame, the frame actuator being configured to change an articulation angle between the rear frame axis and the front frame axis, and one or more sensors configured to determine a configuration of the motor grader; and one or more non-transitory computer-readable media storing computer-executable instructions that, when executed by one or more processors, cause the one or more processors to perform operations comprising:

receive, via a controller communicatively coupled to the one or more sensors, one or more identifiers corresponding to a configuration of the motor grader;

determine, via the controller and based at least in part on the one or more identifiers, a position of the leading edge relative to the rear frame axis; and if the position is not within an operating threshold, cause the controller to actuate the frame actuator to change the articulation angle to move the leading edge to within the operating threshold.

16. The system of claim 15 wherein the blade further includes a trailing edge spaced apart from the leading edge along a blade axis, and wherein determining a position of the leading edge further comprises:

determining a first angle of the blade axis relative to the front frame axis, and determining a second angle of the front frame axis relative to the rear frame axis.

17. The system of claim 16, wherein:

the one or more sensors include a first sensor configured to measure the first angle of the blade axis relative to the front frame axis and a second sensor configured to measure the second angle of the front frame axis relative to the rear frame axis, determining the first angle includes determining, using the first sensor, the first angle, and determining the second angle includes determining, using the second sensor, the second angle.

18. The system of claim 15 wherein causing the frame actuator to change the articulation angle includes using the frame actuator to pivot the front frame and the front frame axis from an initial angle relative to the rear frame axis where the position of the leading edge is not within the operating threshold to a final angle relative to the rear frame axis where the position of the leading edge is within the operating threshold.

19. The system of claim 18 wherein the final angle is less than the initial angle.

20. The system of claim 17 wherein the one or more identifiers include at least one of: a front frame angle identifier, a front frame length identifier, a blade angle identifier, a blade length identifier, a blade width identifier, a blade pitch identifier, a motor grader mode identifier, a motor grader speed identifier, and/or a motor grader transmission gear identifier.

21. The system of claim 15 wherein the operating threshold is a distance from the front frame axis of up to 1 mm, up to 5 mm, up to 10 mm, up to 25 mm, up to 50 mm, up to 100 mm, up to 150 mm, up to 200 mm, up to 300 mm, up to 400 mm, or up to 500 mm.

* * * * *